US005368388A

United States Patent [19]

Fillon

[11] Patent Number: 5,368,388

[45] Date of Patent: Nov. 29, 1994

[54] STIRRER LID DEVICE FOR A PAINT POT

[75] Inventor: Sylvain Fillon, Laboissiere Ecole, France

[73] Assignee: Fillon Pichon S.A., Yvelines, France

[21] Appl. No.: 860,917

[22] Filed: Mar. 31, 1992

[30] Foreign Application Priority Data

Apr. 26, 1991 [FR] France ..... 91 05168

[51] Int. Cl.[5] ..... B01F 7/00

[52] U.S. Cl. ..... 366/245; 366/197; 366/347; 366/605

[58] Field of Search ..... 366/347, 199, 605, 197, 366/207, 209, 242, 247, 244, 245, 249, 281, 284, 283, 282, 251, 252, 253, 254; 220/314, 317, 327, 570, 323

[56] References Cited

U.S. PATENT DOCUMENTS

| | | | |
|---|---|---|---|
| 946,610 | 1/1910 | Malmquist | 366/284 |
| 1,196,931 | 9/1916 | Carpenter | 366/281 |
| 1,196,932 | 9/1916 | Carpenter et al. | 366/281 |
| 1,350,713 | 8/1920 | Ferdon | 220/324 |
| 1,698,402 | 1/1929 | Harris | 366/605 |
| 1,787,060 | 12/1930 | Wolf | 220/323 |
| 2,286,913 | 6/1942 | Kelly et al. | 366/251 |
| 2,764,177 | 9/1956 | Paasche | 366/605 |
| 3,284,057 | 11/1966 | Duquette | 366/605 |
| 3,539,155 | 11/1970 | Agranat | 366/251 |
| 3,831,850 | 8/1974 | Hunter | 366/605 |
| 4,401,268 | 8/1983 | Pomponi, Jr. | 366/605 |
| 4,422,770 | 12/1983 | Geible | 366/605 |

FOREIGN PATENT DOCUMENTS

| | | | |
|---|---|---|---|
| 683 | 8/1896 | Denmark | 366/197 |
| 0125213 | 4/1984 | European Pat. Off. . | |
| 0261996 | 3/1987 | European Pat. Off. . | |
| 0323531 | 11/1987 | European Pat. Off. . | |
| 2475502 | 8/1981 | France | 366/224 |
| 2603255 | 3/1988 | France . | |
| 2231857 | 5/1990 | United Kingdom . | |

*Primary Examiner*—David A. Scherbel
*Assistant Examiner*—Tony G. Soohoo
*Attorney, Agent, or Firm*—Morgan & Finnegan

[57] ABSTRACT

The stirrer lid device is provided with a stirring device carried by a driving shaft extending through the lid via a sleeve. The lid has an underneath portion which defines a groove for a flat and annular sealing gasket having a width selected for compensating manufacturing tolerances between pots various origins. The lid cooperates with means imparting a uniform pressure on the sealing gasket.

6 Claims, 1 Drawing Sheet

STIRRER LID DEVICE FOR A PAINT POT

FIELD AND BACKGROUND OF THE INVENTION

The present invention relates to paint pots comprising a stirrer device lid, with stitching cleric for homogenizing the paint by maintaining the paint under stirring until when it is poured so as to be us directly or mixed with other paints.

The paint pots are, prior to be used, closed a lid having the shape of a cup the peripheral edge of which is frustoconical and bears on the inner wall off bead that has a flange which is fixed, for example by crimping, on an envelope of the paint pot.

At the moment of its use, the lid is removed replaced by a lid with a stirring device.

Till now, the conventional lids with stirring device generally comprise, underneath them, a conical ring which fits inside the flange, just as was the disposable lid.

The tightness is provided by a metal-on-metal contact.

Fixation of the stirrer lid is ensured by two, three or four pivoting cams, nipping the pot flange in order to forcibly introduce the conical sealing ring.

The above known device has various disadvantages.

It should first be noted that, in order to ensure a good tightness, the lid has to be perfectly fitted on the pot. But the pots used by the various paint manufacturers are not of a standardized size. There exists a large number of models with different flange designs and sizes.

It should also be noted that a same paint manufacturer can use pots from several suppliers, and with characteristics which are slightly different.

Therefore, the manufacturer of the stirrer device lids has to make a large number of variants so that these lids are adapted to various pots of paint.

OBJECT AND SUMMARY OF THE INVENTION

The present invention has for its object remedy the hereabove exposed disadvantages and moreover to simplify and improve a transmission of the efforts between the stirrer device lid and the paint pot while in addition facilitating the setting in position on the stirrer lid and then the setting of the pot with its stirrer lid in a cabinet having a driving device for the stirrer.

According to the invention, the stirrer lid device for a paint pot, provided with a rigidly conformed lid a stirring device being carried by a driving shaft extending through the lid via a sleeve, is characterized in that the lid has an underneath portion which defines a groove for a flat flexible annular sealing gasket, this sealing gasket having a width selected for compensating manufacturing tolerances between pots of various origins, the lid cooperating with means imparting a uniform pressure on the sealing gasket.

The uniform pressure imparting means are connected to a stand on which said pot is placed. A pressure applied by said means is therefore distributed not only in a uniform manner on the sealing gasket, but also in a uniform manner on an envelope for said paint pot.

Various other features of the invention will become more apparent from the following detailed description.

BRIEF DESCRIPTION OF THE DRAWINGS

An embodiment of the invention is shown by way of non limiting example in the accompanying drawings, wherein.

DISCLOSURE OF THE PREFERRED EMBODIMENT

The drawings show a paint pot 1 including an envelope 2 at the top of which is fixed a flange 3, for example by crimping at 4.

Figure 3:
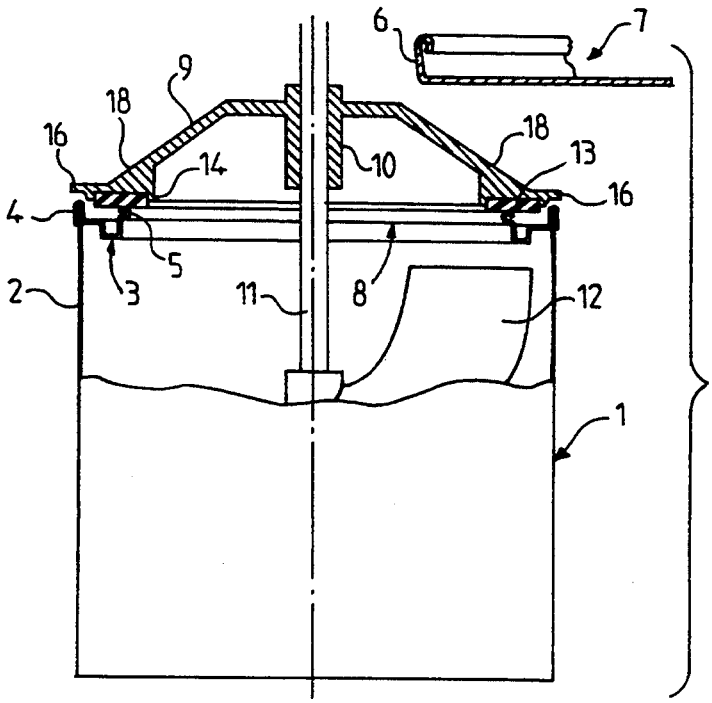
FIG. 3 is a schematic elevation view, partly cross-section, showing a particular feature of the invention.

In a manner known per se, the flange 3 bas an inside bearing bead 5 against which is normally applied an edge 6 of a closing lid 7, partly shown in FIG. 3, and intended for being removed and discarded when the paint pot 1 has to be provided with the stirrer lid device of the invention.

The diameter of an opening 8 which is left free by the bead 5 varies with the paint pot manufacturers, as well as the shape of the flange 3.

According to the invention, there is provided a stirrer lid 9, for example in a moulded material, the conformation of which is selected so that the stirrer lid 9 has a good rigididy.

Synthetic materials or low melting point metals can be used for making the stirrer lid 9 which comprises a sleeve 10 for guiding a shaft 11 of a stirring device 12.

The underneath portion of the stirrer lid 9 is provided with an annular groove 13 for a sealing gasket 14 made of a flexible material, for example a polyethylene foam.

Preferably, the sealing gasket 14 is flat, at least on its underneath portion, and its width as well as the position of the annular groove 13 containing it are selected so that the sealing gasket 14 can cover the bead 5 of pots of variable sizes which belong to a same category of pots, viz. for example the pots from manufacturers of various origins but of same capacity, such as one liter, two liters, etc.

On the other hand, the stirrer lid 9 is provided with means 15 for having the sealing gasket 14 exerting a uniform pressure on the bead 5.

In the drawing, the means 15 includes a set lugs 16 integrally moulded with the lid 9, the lugs 16 having their top portion provided with striations 17 extending transversely on an ascending wall 18.

Figure 1:
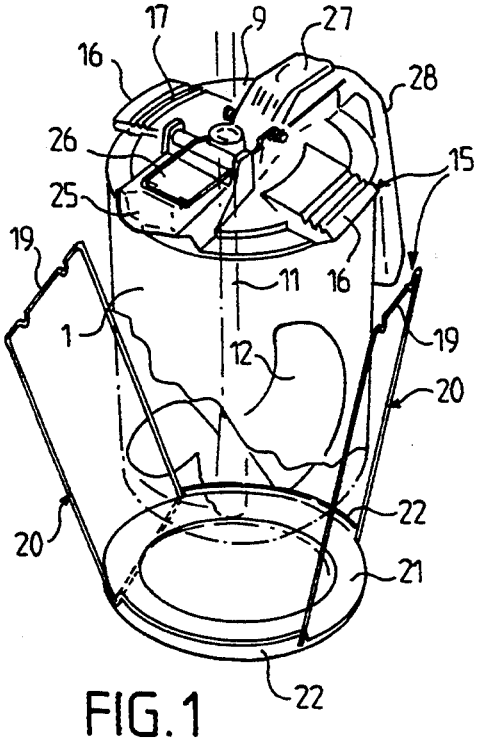
FIG. 1 is an exploded perspective schematic view of a stirrer lid device according to the invention paint pots.
Figure 2:
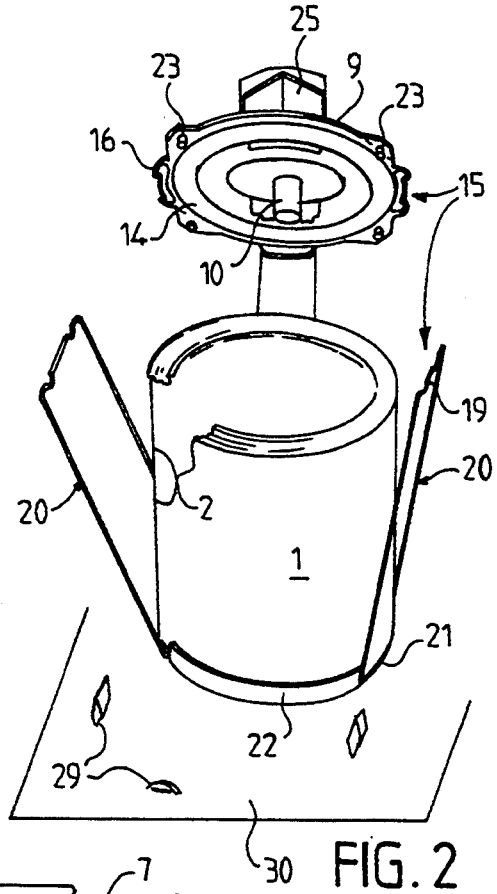
FIG. 2 is a schematic perspective view of the lid device of FIG. 1, in the opened position.

The lugs 16, which are preferably opposite diametrically, protrude beyond the periphery of the stirrer lid 9 and are intended for receiving a cross-piece 19 of bows 20 articulated on a stand The drawing and particularly FIG. 1, show that the stand 21 is advantageously of an annular shape order to correspond to the periphery of the bottom of the pot 1.

It is advantageous that the stand 21 will be provided with edges 22, for example two in number, which are diametrically opposite and which can be used for an articulation of the bows 20.

The edges 22 hold the pot 1 with respect to the bows 20, the cross-piece 19 of which is pushed in order to fit resiliently in the striations 17 of the ascending wall 18 of the stirrer lid 9, for maintaining it while pressing the bead 5 with which the sealing gasket 14 is in engagement.

From the foregoing disclosure, there is seen that the pressure exerted by the means 15 formed by the bows 20 and lugs 16 is transmitted in a uniform manner by the whole of lid 9, which is rigid, to the sealing gasket 14, without the flange 3 being punctually biased, so as to ensure an excellent tightness.

In order to facilitate a correct positioning of the stirrer lid 9, the stirrer lid 9 is provided at the periphery of the sealing gasket 14 with fingers or pins 23 protruding downwardly and adapted for being brought against the outer side wall of the envelope 2 of the pot 1.

A slight clearance can exist between the fingers or pins 23 and the outer wall of the envelope 2 due to the width of the flat sealing gasket 14 which is designed for compensating the manufacturing tolerances and shape differences.

In a known manner, the stirrer lid 9 comprises a pouring spout 25, the closing member 26 of which can be controlled by a trigger 27 mounted above a handle 28.

In addition, the stand 21 permits a centering of the pot provided with its stirrer lid between lugs 29 of a support 30, for example a shelf of a cabinet provided with mechanisms for driving the shaft 11 supported by the stirrer lid 9.

The invention is not restricted to the embodiments shown and described in detail and various modifications thereof can be carried out thereto without departing from its scope. In particular, the means 15 for producing a uniform pressure of the stirrer lid 19 on the bead 5 of the flange 3 can be different from that shown by way of example provided that their function is maintained. It is for example possible to use cam levers supported by the stand 21 so that the pressure applied on the bead 5 will be uniformeously transmitted by the envelope 2, without the envelope risking buckling.

What is claimed is:

1. A stirrer lid device for a paint pot having a side wall, comprising:

a rigidly conformed lid, said lid having an underneath portion which defines a groove for receiving a flat annular sealing gasket, said lid further having a sleeve extending therethrough, and said lid further having lugs and striations;

a flexible sealing gasket disposed within said groove in said underneath portion of said lid, said sealing gasket having a width sufficient to compensate for manufacturing sizes between paint pots of various origins;

a stirring device carried by a drive shaft extending through said sleeve;

a stand for receiving said paint pot; and uniform pressure imparting means for imparting a uniform pressure on said sealing gasket and on said side wall of said paint pot, said uniform pressure imparting means comprising a set of bows articulated onto said stand and including a cross-piece bearing on said striations of said lugs formed by said lid.

2. A stirrer lid device for a paint pot having a side wall, comprising:

a rigidly conformed lid, said lid having an underneath portion which defines a groove for receiving a flat annular sealing gasket, said lid further having a sleeve extending therethrough, and said lid further having lugs and striations, said lugs are provided with an ascending wall and said striations formed on said ascending wall of said lugs;

a flexible sealing gasket disposed within said groove in said underneath portion of said lid, said sealing gasket having a width sufficient to compensate for manufacturing sizes between paint pots of various origins;

a stirring device carried by a drive shaft extending through said sleeve;

a stand for receiving said paint pot; and uniform pressure imparting means for imparting a uniform pressure on said sealing gasket and on said side wall of said paint pot, said uniform pressure imparting means comprising a set of bows articulated onto said stand and including a cross-piece bearing on said striations of said lugs formed by said lid.

3. The stirrer lid device as set forth in claim 1 wherein said stand comprises edges for centering said paint pot.

4. The stirrer lid device as set forth in claim 1 wherein said side wall has a periphery, and wherein said lid has an underneath portion provided with centering lugs extending beyond said periphery.

5. The stirrer lid device as set forth in claim 2, wherein said stand comprises edges for centering said paint pot.

6. The stirrer lid device as set forth in claim 2, wherein said side wall has a periphery, and wherein said lid has an underneath portion provided with centering lugs extending beyond said periphery.

* * * * *